United States Patent [19]

Dering

[11] Patent Number: 4,687,316

[45] Date of Patent: Aug. 18, 1987

[54] COMPUTER GRAPHICS COPY SYSTEM FOR TECHNICAL ILLUSTRATION

[75] Inventor: Timothy A. Dering, Rochester Hills, Mich.

[73] Assignee: Chrysler Motors Corporation, Highland Park, Mich.

[21] Appl. No.: 854,251

[22] Filed: Apr. 21, 1986

[51] Int. Cl.[4] ..... G03G 21/00

[52] U.S. Cl. ..... 355/3 R; 355/77; 355/133

[58] Field of Search ..... 355/3 R, 4, 40, 77, 355/133

[56] References Cited

U.S. PATENT DOCUMENTS

| | | | |
|---|---|---|---|
| 4,265,469 | 5/1981 | Mowry et al. | 355/133 X |
| 4,281,921 | 8/1981 | Van Auken | 355/133 X |
| 4,456,373 | 6/1984 | Best | 355/133 |

*Primary Examiner*—Fred L. Braun

*Attorney, Agent, or Firm*—Wendell K. Fredericks

[57] ABSTRACT

A method for generating finished illustrations from a computer graphic display image is effected using a computer graphic art copy system. A finished illustration is formed from and a visible but non-reproducible reference image formed on a transparency and an enhanced reproducible image formed over the non-reproducible reference image.

4 Claims, 3 Drawing Figures

COMPUTER GRAPHICS COPY SYSTEM FOR TECHNICAL ILLUSTRATION

BACKGROUND OF THE INVENTION

This invention relates to a system for enhancing production artwork and more particularly, in a preferred embodiment, to a method for converting computer graphic display images into enhanced technical illustrations.

DESCRIPTION OF THE PRIOR ART

In prior art computer graphic art copy systems, a document copying machine (e.g., a Xerox copier) is used to capture as a hard copy a displayed image produced by the computer graphic copy machine. For technical illustrations this captured image is in a wire frame format, i.e., showing all edges of an object (forefront, intermediate and aft intermeshed). This image is generally copied on bond paper using a standard color toner, usually a black dry powder, in the Xerox copier forming a reproducible black ink copy of the image.

This reproducible copy is then used by an illustrator to make additional copies of the captured image. However, if there is a need to update the image, for example, to remove a small portion of a corner from the image, a new drawing must be reconstructed. The new drawing is needed because blotting out the small portion of the corner with a cover sheet or other blotting means requires accurate aligning and mounting to achieve suitable results.

If the generated image is a three-dimensional presentation, the copied image usually is not in three-dimensional form. The copied image is a flat presentation with the forefront intermeshed with the aft. When the illustrator tries to use his copied image as a reference sheet to make a finish copy (e.g., a perspective drawing with the primary features delineated) there is usually a problem after placing an overlay over the image, in distinguishing which lines to copy and which lines to omit. If after forming the final copy by copying the primary features of the three dimensional image, the illustrator usually removes the overlay from the image and then makes copies of the finish copy on another copy machine. If it is determined that further work must be done to complete the finish copy, the illustrator must realign the finish copy overlay over the image if available and update the finish copy. Such maneuvers require much care and ofttimes consume considerable time.

SUMMARY OF THE INVENTION

The present invention relates to methods and systems for converting computer graphic images into enhanced technical illustrations. The graphic image is captured and transformed into a visible but non-reproducible reference image on a transparent or translucent transport sheet. The non-reproducible reference image is enhanced using reproducible medium and then copied to produce a finished artwork.

DESCRIPTION OF THE PREFERRED EMBODIMENT

Figure 1:
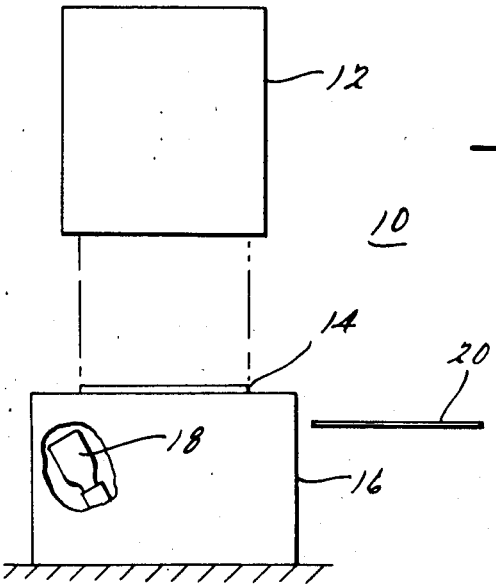
FIG. 1 is a block diagram representation of a computer graphic art copy system.

Referring to FIG. 1 of the drawing, there, a diagram of a computer graphic art copy system 10 is depicted. A computer graphic device 12 forms a computer graphic display image 14, e.g., a three-dimensional image. Within a document copying machine 16, several xerographic processing stations (not shown) are arranged for processing a xerographic plate of the type having a photoconductive layer top surface. Initially, at a charging station, a uniform electrostatic charge is deposited on the plate. Afterwards, at an exposure station, a radiated light pattern of the computer graphic display image is projected onto the surface of the plate dissipating the charge in the exposed areas forming a latent electrostatic image of the computer graphic display image; then at a developing station, a toner developing material 18 having toner particles of an electrostatic charge opposite to that of the latent electrostatic image is applied to the plate's surface so as to cause the toner particles to adhere to the latent electrostatic image forming a toner powder image of the copy being made, the toner powder being a transfer medium; then, at a transfer station, the toner powder image is electrostatically transferred from the plate's surface onto a transfer material forming copy 20; and then, at a plate cleaning station, the plate surface is brushed to remove residual toner particles remaining after the image transfer and a bright light source is used to completely discharge any remaining residual electrostatic charge.

In the present system, the transfer material is a velum or Mylar sheet which is transparent except for the deposited image. The toner material is composed of a mixture of a special colorant, a binder agent and a charged controlling agent. The colorant is of a chosen color which forms a corresponding perceptible color image on the transfer material, but is non-photographic, i.e., copy 20 cannot be reproduced on the copying machine. Although other colors may provide a similar result, it has been found that a non-photo blue toner works well in the present system. Such toners are seldom used because it is most often desired to use a toner that produces copies that can be recopied by the same or a different document copy machine or even photographed by standard photographic equipment. But the non-photographic feature of the present toner permits the illustrator to form a particular kind of reference sheet that will make preparing finish copies of perspective drawings from three-dimensional copies much easier to achieve.

Because of the non-standard use of this non-photographic toner and since it isn't common to dedicate the document copy machine to forming non-photographic copies, a removable toner container may be used so that a second container containing a conventional toner may be inserted into the machine when normal copies are desired.

Figure 2:
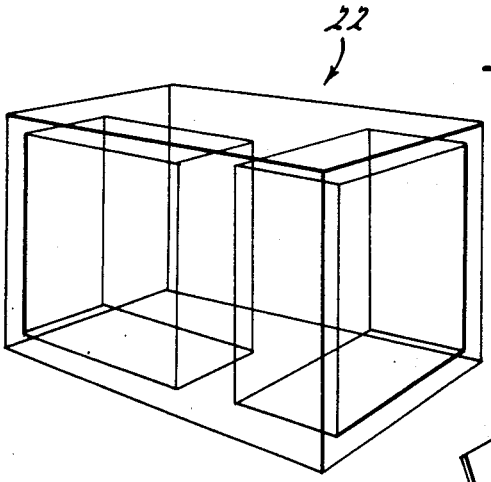
FIG. 2 is a representation of a three-dimensional perspective view copy produced by the computer graphic art copy system of FIG. 1.

Referring now to FIG. 2, there is shown a three-dimensional image of a duct type panel 22 in the wire frame format showing all the length, depth and breadth lines of the panel. In this form, it is extremely difficult for the illustrator to isolate the primary peripheral structure of this figure so as to form a perspective view.

Figure 3:
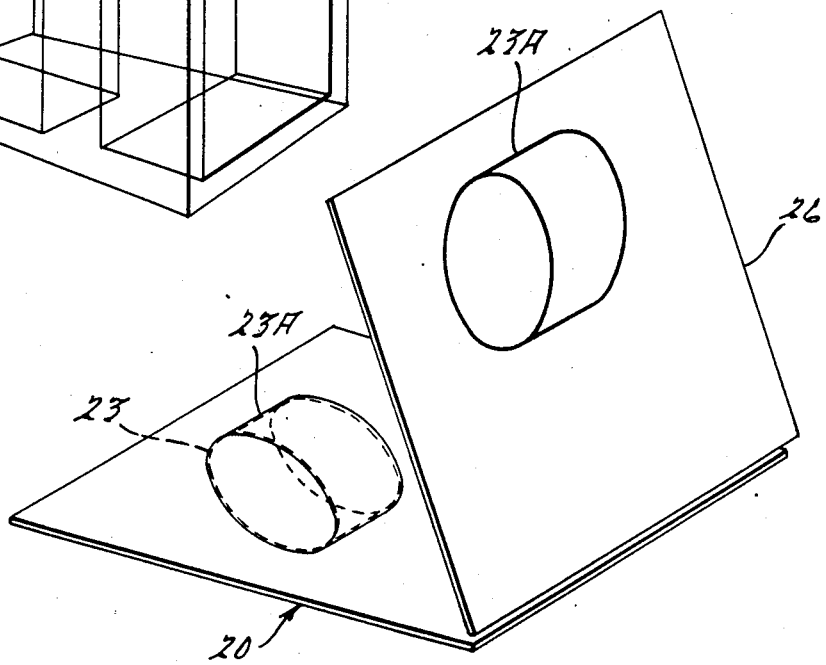
FIG. 3 is a perspective view of a reference sheet containing a flat three-dimensional image and an enhanced illustration of the image.

With reference now to FIG. 3, there is shown a reference sheet 20 of a transparent material containing a three-dimensional reference image 23 in the wire frame format (shown in dotted lines) copied on a back side of a reference sheet 20 with lines formed, illustratively, using a non-photographic but visible blue toner. Because of this intermeshing of the forefront structure with the aft, which occurs from computer generated images, it is difficult to determine the primary peripheral structure of reference image 23. Without using an extra tracing sheet, the illustrator manually highlights or enhances the reference image 23 (shown in solid line) directly on his reference sheet 20 using a reproducible medium such as a pencil or ink. Since reference sheet 20 is translucent, the enhancement can take place on the opposite side of the sheet from the non-reproducible image. Since translucent materials used for such illustrations are usually of a Mylar or velum material, mistakes may be easily removed with a suitable ink or pencil lead remover without distorting the non-reproducible image on the other side of the sheet.

The enhanced image 23A can be copied on a document copier containing a reproducible color toner to produce the finish illustration shown on sheet 26.

What is claimed is:

1. A method for converting a computer graphic display image into a finished illustration comprising the steps of:

a. depositing a uniform electrostatic charge on a xerographic plate of the type having a photoconductive layered top surface, b. disposing said charged xerographic plate in the path of said computer graphic display so that the radiated light pattern of the computer graphic display image is projected onto the photoconductive layered surface of said plate dissipating the charge in the exposed areas forming a latent electrostatic image of the computer graphic display image;

c. applying a toner developing material composed of toner particles of a predetermined color and of an electrostatic charge opposite to that of the latent electrostatic image so as to cause the toner particles to adhere to the latent electrostatic image forming a toner powder image in the predetermined color of the computer graphic display image, said predetermined color being a non-reproducible color;

d. transferring said toner powder image of the computer graphic display image onto a transparent material transfer sheet;

e. manually producing on said transfer sheet using a reproducible medium an enhanced image of said non-reproducible color image disposed on said transfer sheet to form a composite image including said non-reproducible color image superimposed by said reproducible enhanced image; and f. copying said assembly containing said composite image so as to produce a finished illustration of said computer graphic display image.

2. The method of claim 1 wherein said non-reproducible color of said toner is non-photographic blue.

3. The method of claim 1 wherein said transfer sheet is translucent, wherein said non-reproducible colored image is visible through said transfer sheet.

4. The method of claim 3 wherein said non-reproducible image is disposed on one side of said transfer sheet and said enhanced image is disposed on the other side.

* * * * *